US007640911B2

(12) United States Patent
Pien

(10) Patent No.: US 7,640,911 B2
(45) Date of Patent: Jan. 5, 2010

(54) TWO-STROKE, HOMOGENEOUS CHARGE, SPARK-IGNITION ENGINE

(76) Inventor: Pao C. Pien, 840 S. Collier Blvd., Marco Island, FL (US) 34145

( * ) Notice: Subject to any disclaimer, the term of this patent is extended or adjusted under 35 U.S.C. 154(b) by 204 days.

(21) Appl. No.: 11/895,940

(22) Filed: Aug. 28, 2007

(65) Prior Publication Data

US 2009/0056687 A1 Mar. 5, 2009

(51) Int. Cl.
*F02B 25/00* (2006.01)
*F02B 3/00* (2006.01)

(52) U.S. Cl. ..... 123/299; 123/73 PP

(58) Field of Classification Search ..... 123/73 PP, 123/73 AC, 73 B, 299, 27 R, 559.1, 197.3, 123/197.4, 78 E, 78 F, 48 B
See application file for complete search history.

(56) References Cited

U.S. PATENT DOCUMENTS

| | | | | |
|---|---|---|---|---|
| 2,292,233 | A | | 8/1942 | Lysholm |
| 2,820,339 | A | | 1/1958 | Grieshaber et al. |
| 2,917,031 | A | | 12/1959 | Nestorovic |
| 3,093,959 | A | | 6/1963 | Birmann |
| 3,125,076 | A | | 3/1964 | Mullaney |
| 3,672,160 | A | | 6/1972 | Kim |
| 3,808,818 | A | | 5/1974 | Cataldo |
| 3,924,576 | A | | 12/1975 | Siewert |
| 4,023,365 | A | | 5/1977 | van Ginhoven |
| 4,050,420 | A | | 9/1977 | Cataldo |
| 4,280,468 | A | | 7/1981 | Millman |
| 4,520,765 | A | | 6/1985 | Gerace |
| 4,541,246 | A | | 9/1985 | Chang |
| 4,663,938 | A | | 5/1987 | Colgate |
| 4,783,966 | A | | 11/1988 | Aldrich |
| 4,815,423 | A | | 3/1989 | Holmer |
| 4,918,923 | A | | 4/1990 | Woollenweber et al. |
| 5,033,418 | A | * | 7/1991 | Maissant et al. ..... 123/70 V |
| 5,117,788 | A | | 6/1992 | Blaser |
| 5,228,415 | A | | 7/1993 | Williams |
| 5,265,562 | A | | 11/1993 | Kruse |
| 5,311,739 | A | | 5/1994 | Clark |
| 5,341,771 | A | | 8/1994 | Riley |
| 5,460,128 | A | | 10/1995 | Kruse |
| 5,566,650 | A | | 10/1996 | Kruse |
| 5,665,272 | A | | 9/1997 | Adams et al. |
| 6,058,904 | A | | 5/2000 | Kruse |
| 6,223,846 | B1 | | 5/2001 | Schechter |
| 6,323,463 | B1 | | 11/2001 | Davis et al. |
| 6,405,704 | B2 | | 6/2002 | Kruse |

(Continued)

FOREIGN PATENT DOCUMENTS

| | | | |
|---|---|---|---|
| WO | WO 87/07325 | * | 12/2003 |

*Primary Examiner*—Hai H Huynh
(74) *Attorney, Agent, or Firm*—Whiteford, Taylor & Preston LLP; Jeffrey C. Maynard; Gregory M. Stone

(57) ABSTRACT

A method for combusting fuel in an engine using a two-stroke homogeneous charge spark-ignition cycle. The method involving injecting fuel into partially compressed hot air to provide a homogenous charge to the cylinder before second stage compression in the cylinder, the engine having two variable compression ratios, a first variable compression ratio such that spark ignited HCCI-like combustion being emission free, and a second variable compression ratio for preventing pre-ignition at high loads. The expansion process of the engine having a chosen expansion ratio much greater than the compression ratio.

16 Claims, 2 Drawing Sheets

U.S. PATENT DOCUMENTS 6,457,309 B1 10/2002 Firey
6,481,206 B1 11/2002 Pien
6,848,416 B1 2/2005 Pien
6,951,211 B2 10/2005 Bryant
7,114,485 B2 10/2006 Pien
7,438,025 B2 * 10/2008 Yang ..... 123/27 R
2003/0136356 A1 7/2003 Namkung
2004/0244732 A1 12/2004 Kojic et al.
2009/0125211 A1 * 5/2009 Akihisa et al. ..... 701/103

* cited by examiner

TWO-STROKE, HOMOGENEOUS CHARGE, SPARK-IGNITION ENGINE

BACKGROUND OF THE INVENTION

1. Field of the Invention

The present invention relates to internal combustion engines and, more particularly, to a two-stroke, homogeneous charge spark ignition (HCSI) engine cycle designed to solve the major obstacles preventing the commercialization of homogeneous charge compression ignition (HCCI) engines.

2. Background

Over the past several years, homogeneous charge compression ignition (HCCI) engines have held the promise of providing cleaner burning and more fuel efficient internal combustion engines. Characterized by the autoignition of a compressed lean homogenous charge, the entire compressed fuel/air mixture burns simultaneously avoiding further compression of already burned gases, which is the primary cause for the high combustion temperatures that cause the formation of NOx. Several obstacles, however, have thus far hindered the development of a commercially viable HCCI engine. Over-expanded HCCI engines are described in U.S. Pat. No. 7,114,485 to Pien, the specification of which is incorporated herein by reference.

Current HCCI engine research has focused on the four-stroke engine. For a four-stroke engine, the expansion ratio and geometric compression ratio are the same and equal to the ratio between cylinder total volume and cylinder clearance volume. The effective compression ratio, however, is the ratio between the air density within the cylinder clearance volume and the density of the ambient air. Since the air density in the clearance volume is controlled by the throttle valve or a supercharger, the effective compression ratio of a four-stroke engine is a variable, while the expansion ratio is fixed.

In HCCI engines, it is difficult to control autoignition and to operate at the required range of operating loads because of the difficulty of controlling the chemical kinetics of combustion over a range of loads. Moreover, with a four-stroke engine configuration, achieving high fuel efficiency requires a high compression ratio, which leads to high combustion temperature and NOx formation. The two-stroke HCSI engine employs a spark to trigger the flashpoint of a homogenous charge to achieve HCCI-like combustion.

With HCCI combustion, the whole fuel/air mixture burns at the same time and no part of the products of combustion is compressed into a higher temperature. Autoignition will take place whenever the fuel/air mixture is compressed to reach a flashpoint. As long as combustion temperature is less than the threshold temperature of NOx formation, lean HCCI combustion is emission free. When a lean homogeneous charge is compressed to a temperature close to, but below, the flashpoint, combustion of the charge initiated by a spark is close to emission free. At high loads where the threshold temperature for NOx formation may be exceeded, combustion will be emission-free except for NOx.

To prevent knocking and engine damage at high-loads, the compression ratio of an HCSI engine must be greatly reduced. Such reduction of the compression ratio, however, will not diminish engine thermal efficiency since engine thermal efficiency is already determined by the fixed expansion ratio.

SUMMARY OF THE INVENTION

The primary objective of this invention is to create a homogeneous charge spark ignition (HCSI) engine operating cycle designed to utilize a spark to initiate/control the timing of ignition of a homogenous charge. The unique design of the new engine and combustion mode achieve HCCI-like combustion with the associated benefits, while solving the challenge of controlling the timing of autoignition of the homogeneous charge.

The new engine utilizes a large expansion ratio for achieving high fuel efficiency at all-loads. At the same time, the compression ratio of the new engine is variable to meet two different combustion design requirements. The first design requirement is to prevent pre-ignition at high-loads. To meet this requirement, a much smaller ratio than the expansion ratio is selected. The second design requirement is to allow the compressed lean homogeneous charge to reach a temperature very close to, but below the mixture's flashpoint. To achieve this second design requirement, the compression ratio is varied depending on operating conditions. The new two-stroke HCSI engine achieves the thermal efficiency of a diesel engine without a diesel's shortcomings and burns essentially emission-free.

The HCSI engine of the present invention differs from other HCCI or spark induced engines by using a spark to essentially trigger HCCI-like combustion of the homogenous charge that has been compressed to a temperature just below the flashpoint of the charge. The disclosed HCSI gasoline engine selects a high expansion ratio for obtaining high thermal efficiency at all-loads and a lower compression ratio for preventing pre-ignition at high-loads such that it can achieve the diesel engine fuel efficiency without the shortcomings of the diesel engine Accordingly, it is an object of the invention to enable a two-stroke engine cycle that avoids the disadvantages of the prior art.

Another objective is to create a two-stroke engine operating on an improved engine cycle.

It is another object of the invention to provide a two-stroke engine that reduces NOx emissions.

It is a further object of the invention to provide a two-stroke engine having reduced CO and HC emissions.

In accordance with the above objects, the invention overcomes the limitations of existing internal combustion engines and provides a method and an engine for promoting homogeneous charge spark ignition.

Some of the advantages include:

1. A two-stroke HCSI engine that achieves greater fuel efficiency than a diesel engine without the shortcomings of the diesel engine.
2. A two-stroke HCSI engine that initiates homogeneous charge combustion by spark ignition rather than compression ignition, reducing manufacturing and operating costs and prolonging engine life.
3. A two-stroke HCSI engine that can operate with HCCI-like combustion across changing power demands by automatically switching variable compression ratios between two values.
4. A two-stroke HCSI engine that is fuel-flexible and can be expected to run on "straight run" petroleum products.
5. A 50% downsizing is possible at low-loads as compared with a four-stroke diesel engine having the same displacement volume, significantly increasing vehicle payload per trip.
6. Vehicles operating in urban areas require a small fraction of installed engine power and can run on HCSI mode essentially emissions free.
7. Utilizing a homogeneous charge and with high brake efficiency, a two-stroke HCSI engine can run at a much lower idling speed for additional fuel savings.

8. The HCSI engine can be developed immediately with existing technologies.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF EXEMPLARY EMBODIMENTS

Figure 1:
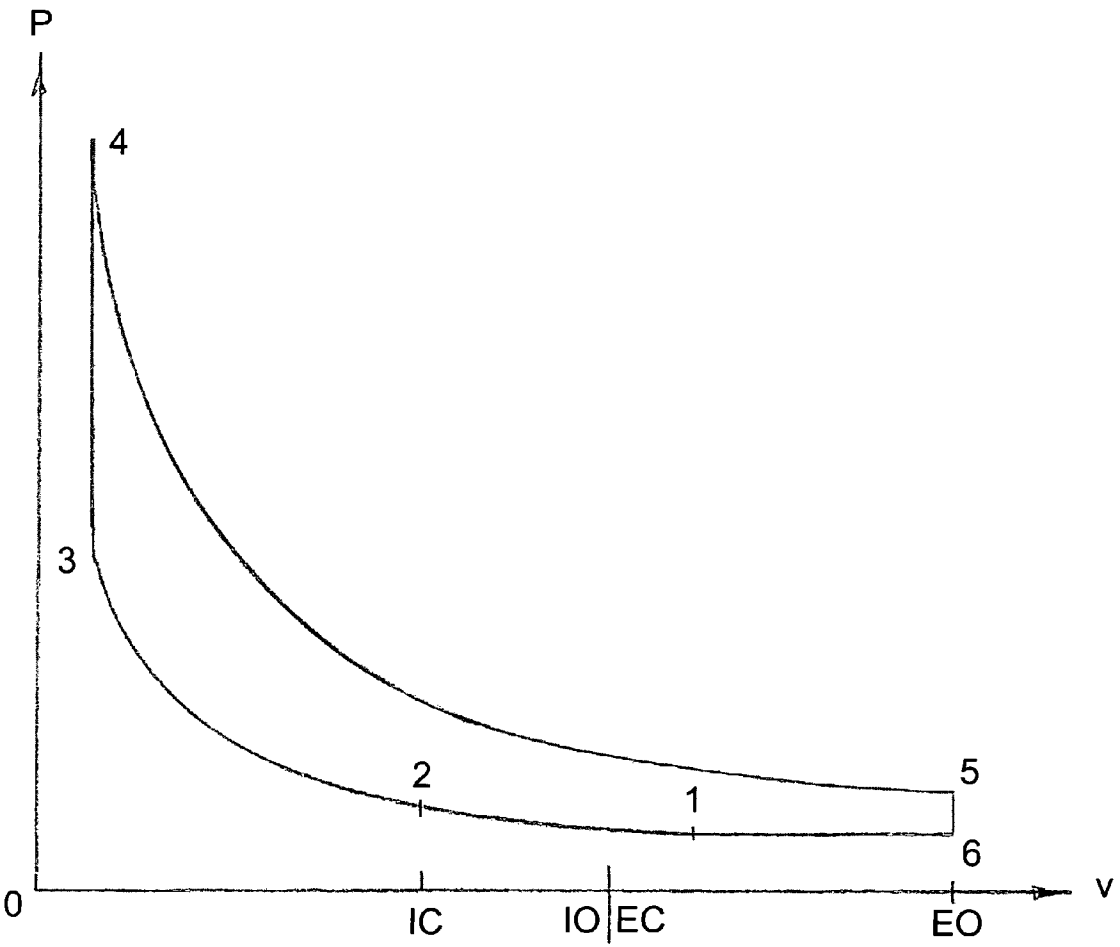
FIG. 1 illustrates a P-V diagram of an HCSI cycle according to the present invention.

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

For a four-stroke engine, the expansion ratio and geometric compression ratio are the same and equal to the ratio between cylinder total volume and cylinder clearance volume. The effective compression ratio, however, is the ratio between the air density within the cylinder clearance volume and the density of the ambient air. Since the air density in the clearance volume is controlled by the throttle valve or a supercharger, the effective compression ratio of a four-stroke engine is a variable, while the expansion ratio is fixed.

Because the thermal efficiency is a function of the expansion ratio rather than the compression ratio, a fixed expansion ratio much greater than the compression ratio is first selected to achieve a high thermal efficiency at all loads. The ratio between the gas density within the cylinder clearance volume and that of the ambient air is equal to the effective compression ratio. The airflow per two revolutions is equal to cylinder clearance volume x the compression ratio for a four-stroke engine and twice that for a two-stroke engine. For increasing power density, a two-stroke configuration is employed. In this configuration, the piston-cylinder assembly is the same of a four-stroke engine, while the difference in stroke lengths between the longer expansion stroke and the shorter compression stroke is utilized to facilitate the replacement of cylinder exhaust gas with fresh charge. For reducing engine moving parts, the new two-stroke engine has a crankcase compressor that is connected to the cylinder block by a tube. A section of the tube is narrowed to form a "venturi" which has a hole as a "jet" to receive fuel from a low-pressure jerk-pump. Because the jet is located downstream of the crankcase compressor, the injected fuel evaporates quickly and mixes thoroughly with the hot air to provide homogeneous charge to the cylinder. Accordingly, the new two-stroke engine becomes a two-stroke homogeneous charge fuel-flexible engine capable of operating on fuels other than gasoline.

A crankcase compressor can adjust instantly to the requirement of airflow change, while a supercharger cannot.

FIG. 1 shows a P-V diagram of a two-stroke constant-volume cycle that the HCSI engine has been designed to operate on.

A two-stroke HCSI engine has:

(i) A two-stage compression process 1-2-3 with the first stage compression process 1-2 performed by crankcase compressor and the second stage carried out in the cylinder;

(ii) A constant volume combustion process 3-4;

(iii) An expansion process 4-5;

(iv) A blowdown process 5-6; and (v) A replenishing process 6-2 to replace cylinder exhaust gas with fresh homogeneous charge.

The cycle starts at point 1. From point 1 to point 2, a first compression process takes place to reduce the volume of air to $V_2$ and increase the pressure to $P_2$. $P_2$ reflects the pressure of partially compressed air, produced by a crankcase compressor depicted in FIG. 2. A second compression process takes place from point 2 to point 3 by reducing the volume in the cylinder. The process 1-2-3 is a two-stage compression process having variable compression ratio to meet two different combustion design requirements. From point 3 to point 4, a spark initiates the combustion and heat is added under constant volume, increasing the combustion temperature and pressure. From point 4 to point 5, an expansion process takes place having a chosen expansion ratio (by having sufficiently large total cylinder volume $V_5$ relative to the clearance volume $V_3$). From point 5 to point 6, a blow down process removes heat under constant volume. From point 6 to point 1, heat is removed under constant pressure to complete the cycle.

The compression process 1-2-3 has two parts. First, process 1-2 is performed in a crankcase compressor with the entrance of the partially compressed homogenous mixture to cylinder occurring at a point between points 1 and 2 when the intake valve opens, indicated by IO in FIG. 1. The crankcase air compressor provides partly compressed hot air to the tube connected to the cylinder block. Fuel is injected into the partially compressed hot air causing the fuel to evaporate quickly and mix thoroughly with the hot air to provide a homogeneous charge to the engine cylinder. For low-loads, the second part of the compression process 2-3 takes place in the engine cylinder (by the upward movement of the piston) wherein the homogenous mixture is compressed to reach a compression temperature $T_3$ of approximately 900° K. (or just below the autoignition temperature of the compressed charge).

A variable timing intake valve varies the closing timing at point 2 to control engine compression ratio and thus the compression temperature at the end of the second part of the compression process (from 2-3) to reach a temperature of 900° K. (or other temperature just below the autoignition temperature). Since the lean homogeneous charge enters the cylinder with a predictable temperature and because of the very short duration of the compression process 2-3 (for pre-combustion chemical kinetic interaction), the required compression temperature $T_3$ at point 3 can be easily obtained regardless of engine rpm and load by controlling the timing of the closing of the intake valve.

A spark triggers the flashpoint of the homogeneous charge to achieve HCCI-like combustion.

For high-loads, the closing time of the intake valve is delayed to reduce the compression ratio such that the pre-ignition will not occur.

The ensuing expansion process extends beyond $V_1$ to reach $V_5$ as shown in FIG. 1. At point 5, the exhaust valve opens (indicated by EO) near the end of expansion process to begin a blowdown process 5-6. An exhaust process begins when the piston moves away from bottom dead center ('BDC') and begins its upward motion. The exhaust process ends when the exhaust valve closes (indicated by EC). The intake valve opens (indicated by IO) coinciding with the exhaust valve closing so that all of the air delivered by crankcase compressor is utilized for combustion. When the intake valve closes (indicated by IC), second stage compression process 2-3 starts in the cylinder. The compression ratio is a function of fresh charge trapped within the cylinder when the intake valve closes. Therefore, the closing time of the intake valve can be varied to control the compression ratio.

Since $V_2$ is less than one half of $V_6$, the availability of a portion of the upward stroke for replenishing process 6-2 to replace cylinder exhaust gas with fresh homogeneous charge. A two-stroke engine is shown in FIG. 2 with the first stage compression process 1-2 being done by the crankcase compressor.

Figures 2A, 2B:
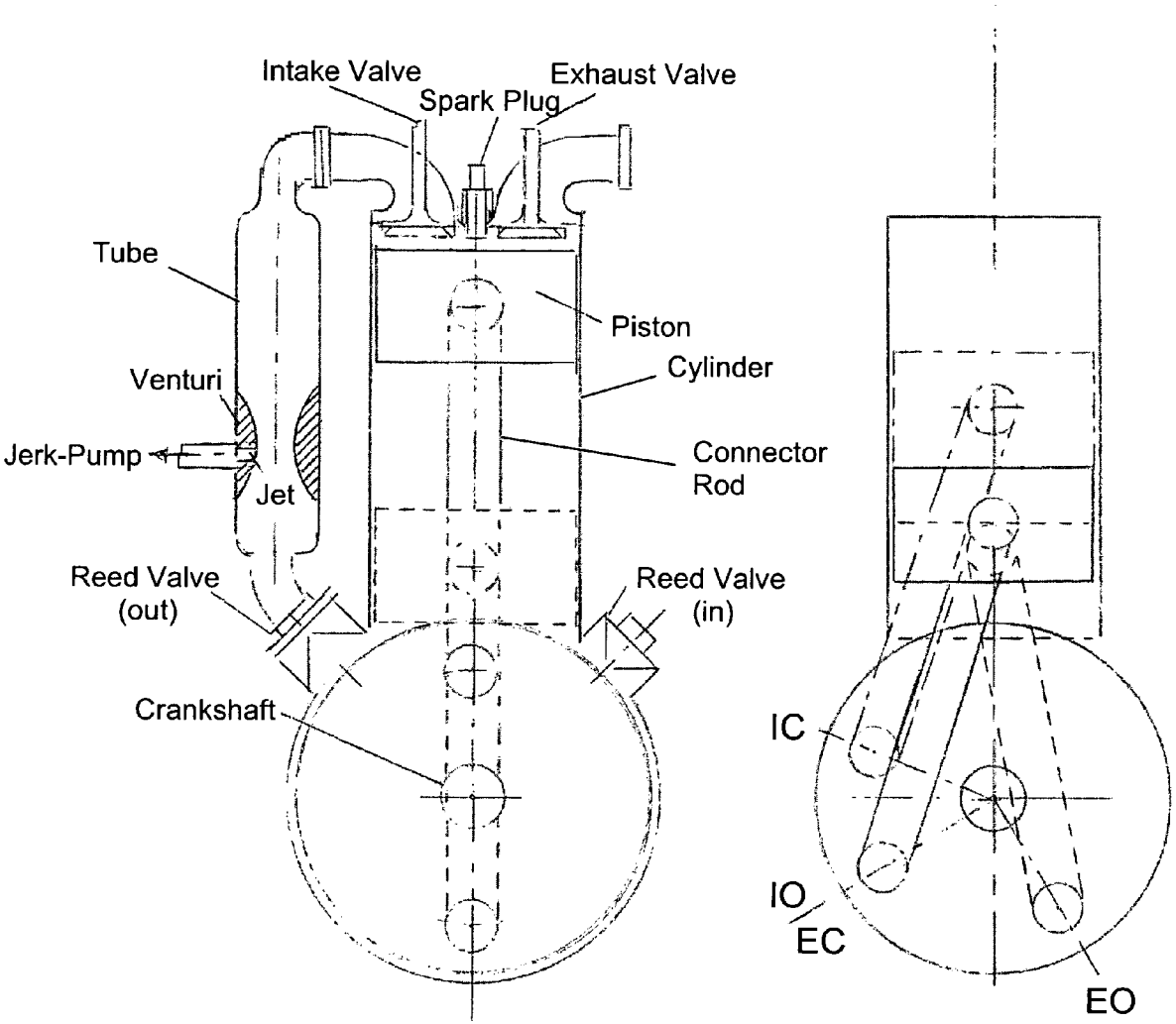
FIG. 2 shows a schematic view of a two-stroke engine with crankcase compressor according to the present invention.

FIGS. 2*a* and 2*b* show schematic views of a two-stroke HCSI engine with a crankcase air compressor. The engine comprises at least one cylinder containing a piston connected to a crankshaft by means of a connector rod. At the top of the cylinder, are an intake valve and an exhaust valve. The intake valve provides homogenous charge to the cylinder that comes from the mixing of air from the crankcase compressor and injected fuel by way of the venturi. A spark plug provides an ignition source to the cylinder at an appropriate time during the engine cycle. FIG. 2*a* shows the piston at TDC and BDC positions by solid and dotted lines, respectively. This two-stroke engine utilizes a unique piston configuration that enables the piston to serve both its traditional function as well as a crankcase air compressor. This latter function is accomplished with a sealed crankcase around the crankshaft. Air into and out of the crankcase compressor is controlled by the reed valves. The upward stroke draws atmospheric air into the crankcase through a first reed valve. The down stroke compresses the air within the crankcase and delivers it to an attached tube through a second reed valve, as shown in FIG. 2*a*. The air is partially compressed and warmed by the heat of the crankcase and the heat of compression. The output of the crankcase compressor is connected to the cylinder by the tube. A section of the tube is narrowed to form a "venturi" which has a hole as a "jet" to receive fuel from a low-pressure jerk-pump (not shown). Because the jet is located downstream of the crankcase compressor, the injected fuel evaporates quickly and mixes thoroughly with the hot air. The crankcase compressor and venturi jet enable a fuel/mixture delivery arrangement such that fuel is injected into partially compressed hot air causing the fuel to evaporate quickly and mix thoroughly with hot air to provide homogeneous charge to the engine cylinder at all loads. Accordingly, a two-stroke HCSI engine is fuel-flexible capable of operating on fuels other than gasoline.

FIG. 2*b* shows the exhaust valve and intake valve timings. On the engine side above the piston, near the end of a down stroke, the exhaust valve opens (EO) to begin a blowdown process. As the piston moves in the opposite direction, the exhaust valve closes (EC) and the intake valve opens (IO). The second stage compression process begins when intake valve closes (IC).

On the crankcase compressor side, the less fresh charge is trapped in the cylinder, the higher is the pressure in the connecting tube and the smaller is the compressor volumetric efficiency and vice versa. Because the engine displacement volume is equal to that of the crankcase compressor, the inverse of the compressor volumetric efficiency becomes the ratio between the expansion ratio and the compression ratio of the engine. Since the expansion ratio is fixed, the intake valve closing time controls the compression ratio.

It is known that the autoignition temperature of hydrocarbon fuel is between 900°-1000° K. Because of the very short duration of the compression process 2-3 (for pre-combustion chemical kinetic interaction), a compression ratio of 14.5 will give a compression temperature of 906.4° K. at the end of compression process 1-2-3. To start a two-stroke HCSI engine and to run at low loads, the variable compression ratio assumes a value of 14.5 to provide a compression temperature slightly below the autoignition temperature. For high loads, the variable compression ratio is switched from 14.5 to a sufficiently low value to prevent pre-ignition. Even though this lower compression ratio means that a lower volume of homogeneous charge is admitted to the cylinder, fuel injection per cycle is increased to meet the power demand. For high thermal efficiency at all loads, a fixed expansion ratio of 16 is chosen for purposes of the invention disclosure.

Table 1 shows the thermodynamic analysis of the newly designed two-stoke HCSI engine based on heat energy balance.

TABLE 1

| | | | | | | | |
|---|---|---|---|---|---|---|---|
| 1 | $C_i$ | 1 | 2 | 3 | 4 | 5 | 6 |
| 2 | $\phi_i$ | 0.05 | 0.1 | 0.15 | 0.2 | 0.25 | 0.3 |
| 3 | $Q_{3\text{-}4,j}$ | 60 | 120 | 180 | 240 | 300 | 360 |
| 4 | $T_{3,j}$ | 906.4 | 906.4 | 906.4 | 906.4 | 906.4 | 906.4 |
| 5 | $P_{3,j}$ | 621.2 | 621.2 | 621.2 | 621.2 | 621.2 | 621.2 |
| 6 | $T_{4,j}$ | 1101 | 1296 | 1491 | 1686 | 1881 | 2076 |
| 7 | $P_{4,j}$ | 74.6 | 888.2 | 1022 | 1155 | 1289 | 1423 |
| 8 | $T_{5,j}$ | 363.2 | 427.5 | 492 | 556.4 | 620.5 | 685.1 |
| 9 | $P_{5,j}$ | 15.55 | 18.31 | 21.07 | 23.81 | 26.58 | 29.33 |
| 10 | $T_{6,j}$ | 343.3 | 343.2 | 343.3 | 343.5 | 343.2 | 343.4 |
| 11 | $Q_{5\text{-}6,j}$ | 6.13 | 25.95 | 45.77 | 65.53 | 85.35 | 105.2 |
| 12 | $Q_{6\text{-}1,j}$ | 13.95 | 13.91 | 13.95 | 14.04 | 14 | 13.95 |
| 13 | $Q_{5\text{-}6\text{-}1,j}$ | 20.08 | 39.86 | 59.72 | 79.57 | 99.35 | 119.15 |
| 14 | $n_{t,j}$ | 66.50% | 66.80% | 66.80% | 66.80% | 66.90% | 66.90% |

Row 1 is the column number "$C_i$" with i equal to 1 to 6 for six different heat additions given in Rows 2 and 3. Rows 4 and 5 are compression temperature and pressure, respectively, for a compression ratio of 14.5. Rows 6 and 7 are combustion temperature and pressure at the end of combustion process 3-4. Rows 8 and 9 are exhaust temperature and pressure at the end of expansion process 4-5 for an expansion ratio of 16. Row 10 is the temperature at the end of blowdown process 5-6. Rows 11 and 12 are heat rejection at constant volume $Q_{5\text{-}6,j}$ and constant pressure $Q_{6\text{-}1,j}$. Row 13 $Q_{5\text{-}6\text{-}1,j}$ is the total heat rejection. Row 14 is the thermal efficiency.

As shown in Row 14, the thermal efficiency of a two-stroke HCSI engine is 66.8% as compared with a four-stroke SI engine having a compression ratio of 9 with a thermal efficiency of 58.5%. The airflow of the two-stroke engine having an expansion ratio of 16 per two revolutions is equal to $2\times0.975\times14.5=28.275$. The airflow of the four-stroke engine having a compression ratio of 9 per two revolutions is $1.733\times9=15.6$. The ratio of the airflow rate between the two-stroke and four-stroke engines is equal $28.275/15.6=1.81$ (also the power density ratio). For a four-stroke SI engine at $\phi=0.3$, the mechanical efficiency is approximately 65%. Whereas the mechanical efficiency of a two-stroke engine is equal to 1.0–

0.35/1.81=0.81. The brake efficiency ratio is equal to (66.8/58.5)(0.81/0.65)=1.423 indicating a fuel saving of 30%.

The displacement ratio between a two-stroke HCSI engine with a compression ratio of 14.5 and a four-stroke diesel engine with a compression ratio of 16 is equal to 2(15.6−1.076)/(15.6−0.975)=1.99. At the same rpm, a two-stroke HCSI engine requires only one-half of the displacement volume of a four-stroke diesel engine for the same engine output. Having one-half of the mechanical losses per power output and slightly high thermal efficiency, the two-stroke HCSI engine will have higher brake efficiency as compared to a four-stroke diesel engine with the same displacement volume.

Moreover, the simple two-stroke engine configuration helps to minimize pre-combustion chemical kinetics, facilitating the control of the temperature of the compressed homogenous charge by varying the compression ratio. For all loads, homogeneous charge combustion takes place and there are essentially no pollutants, except NOx at high-loads.

Variable valve timing (VVT) technology required to vary the compression ratio is already available. Researchers at Stanford University have used an electro-hydraulic system to induce HCCI combustion, to control combustion timing, and to switch between SI and HCCI operation from one cycle to the next. In the case of a two-stroke HCSI engine, a VVT system is employed to switch intake valve timing automatically between HCSI at low loads and at high loads.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is my intention to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A spark induced, two-stroke HCSI cycle for operating an HCSI engine comprising:

a compression process 1-2-3, said compression process 1-2-3 further comprising:

a first compression process 1-2 carried out via a crankcase compressor; and a second compression process 2-3 carried out by changing the volume of a cylinder of said engine;

a fuel injection process taking place in a tube connecting said crankcase compressor to said cylinder, after said first compression process 1-2, wherein fuel is injected into hot partially compressed gas providing homogeneous charge to the cylinder at all loads;

a heat addition process 3-4 carried out via a spark triggering ignition of the compressed homogenous charge;

an adiabatic expansion process 4-5;

a heat removal process 5-6-1, said heat removal process 5-6-1 further comprising:

a first heat removal process 5-6 under a constant volume; and a second heat removal process 6-1 under constant pressure;

wherein said compression process, said heat addition process, said adiabatic expansion process, and said heat removal process combine to form a two-stroke homogenous charge spark- ignition HCSI cycle 1-2-3-4-5-6-1.

2. The HCSI cycle of claim 1, wherein the change of volume associated with the compression process 1-2-3 is less than the change of volume associated with the heat addition and adiabatic expansion processes 3-4-5.

3. The HCSI cycle of claim 1, wherein the spark triggering the ignition process is timed to occur while the temperature of the homogeneous charge is slightly below its autoignition temperature.

4. A method for combusting fuel in an engine comprising:

decreasing a first volume of air to a second volume via a crankcase compressor;

injecting fuel into said second volume of air to create a homogeneous charge;

further decreasing the second volume to a third volume while increasing a pressure and a temperature thereof;

applying a spark to said homogeneous charge at said third volume thereby increasing pressure and temperature thereof at constant volume via ignition combustion of the compressed homogeneous charge;

increasing the third volume to a fourth volume while decreasing the pressure and temperature thereof;

decreasing the pressure to atmospheric pressure while removing heat at a constant volume; and decreasing the fourth volume to the first volume while removing heat under constant pressure.

5. The method of claim 4, wherein at low-loads the equivalence ratio of the homogenous charge ensures that the post-combustion temperature will not exceed the threshold temperature at which NOx formation occurs.

6. The method of claim 4, wherein the step of increasing the third volume to a fourth volume is an adiabatic expansion.

7. An engine comprising an engine cycle having:

a large expansion ratio for high thermal efficiency at all-loads; and a smaller variable compression ratio switching between two values, one value to achieve a compression temperature very close to but below the homogeneous charge autoignition temperature for low-loads and a much smaller value to avoid pre-ignition for high-loads.

8. The engine of claim 7, further comprising a crankcase compressor providing partially compressed air to said engine.

9. The engine of claim 8, further comprising a venturi to enable fuel injection in order to provide a partially compressed homogeneous air/fuel mixture to said engine.

10. The engine of claim 9, further comprising:

an HCSI cycle engine adapted to combust fuel by:

admitting air to said crankcase compressor:

decreasing a first volume of said air to a second volume via the crankcase compressor;

injecting and mixing an amount of fuel in said venturi to create a homogeneous charge;

decreasing the second volume of said homogeneous charge to a third volume while increasing a pressure and a temperature thereof;

using a spark to initiate ignition of said homogeneous charge, thereby increasing a pressure and a temperature of said homogenous charge;

increasing the third volume to a fourth volume while decreasing the pressure and temperature thereof;

decreasing the pressure to atmospheric pressure while removing heat at a constant volume; and decreasing the fourth volume to the first volume while removing heat under constant pressure.

11. The engine of claim 10, wherein combustion temperature does not exceed a pre-determined temperature selected to be less than the threshold temperature at which NOx formation takes place.

12. The engine of claim 10, wherein the third volume is increased to the fourth volume by adiabatic expansion.

13. The engine of claim 10, said engine having a two-stroke construction comprising:

a first stroke enabling a combustion process at its beginning with an expansion process throughout its entire stroke; and a second stroke having more than one half of said second stroke allocated for exhaust processes, with the remaining portion of said stroke allocated for admitting partially compressed homogeneous charge to the cylinder and further compression of said partially compressed homogenous charge.

14. The engine of claim 13, wherein said engine achieves an expansion process having a longer stroke than the stroke for said compression process.

15. The engine of claim 13, wherein said engine achieves the difference in stroke lengths for the expansion and compression processes by varying the timing of the intake and exhaust valves.

16. The engine of claim 13, said engine having a power stroke for each revolution of a crankshaft.

* * * * *